US007065823B2

(12) United States Patent
Llanes

(10) Patent No.: US 7,065,823 B2
(45) Date of Patent: Jun. 27, 2006

(54) CYLINDER ATTACHMENT TO WRING WATER OUT OF MOP IN PAIL WITH HOLDING TRAY

(76) Inventor: Joselito L. Llanes, 306 Union St., Jersey City, NJ (US) 07304

( * ) Notice: Subject to any disclaimer, the term of this patent is extended or adjusted under 35 U.S.C. 154(b) by 36 days.

(21) Appl. No.: 10/895,969

(22) Filed: Jul. 22, 2004

(65) Prior Publication Data

US 2006/0016031 A1 Jan. 26, 2006

(51) Int. Cl.
*A47L 13/14* (2006.01)
*A47L 13/58* (2006.01)

(52) U.S. Cl. ..... 15/119.1; 15/260

(58) Field of Classification Search ..... 15/116.1, 15/119.1, 120.1, 260, 263
See application file for complete search history.

(56) References Cited

U.S. PATENT DOCUMENTS

| | | | | |
|---|---|---|---|---|
| 694,469 | A * | 3/1902 | Geddes | 15/263 |
| 1,709,622 | A | 4/1929 | Justis | |
| 1,751,349 | A | 3/1930 | Morgan | |
| 1,957,612 | A * | 5/1934 | Pennock | 15/263 |
| 3,040,354 | A | 6/1962 | Vosbikian et al. | |
| 3,364,512 | A | 1/1968 | Yamashita et al. | |
| 3,462,788 | A | 8/1969 | Abbott | |
| 4,164,800 | A | 8/1979 | Strahs | |
| 5,060,338 | A | 10/1991 | Yates et al. | |
| 5,675,857 | A * | 10/1997 | Hirse | 15/119.1 |
| 5,675,858 | A | 10/1997 | von Meyer | |
| 5,724,694 | A | 3/1998 | Lewis | |
| 5,976,266 | A | 11/1999 | Anderson et al. | |
| 5,996,161 | A | 12/1999 | Facca | |
| 6,115,869 | A | 9/2000 | Libman | |
| 2002/0092105 | A1 | 7/2002 | Laux et al. | |

FOREIGN PATENT DOCUMENTS

| | | |
|---|---|---|
| DE | 36 07 121 A1 | 9/1987 |
| FR | 2 662 785 A1 | 5/1989 |
| GB | 185941 | 9/1922 |
| GB | 593452 | 10/1947 |

OTHER PUBLICATIONS

Wonder Mop (Reg.), http://www.libmanjansen.com/catalog/pages/2000.html; Nov. 18, 2003, 1 page.

* cited by examiner

*Primary Examiner*—Randall Chin
(74) *Attorney, Agent, or Firm*—Richard C. Litman

(57) ABSTRACT

The cylinder attachment to wring water out of mop is a frusto-conical shaped cylinder having a neck that is slidably attached to a mop handle. The neck has an adjustable knob that removably secures the cylinder in position at any point on the mop handle. The cylinder has an array of apertures in its lower wider portion for release of the mop water when the dirty water-laden mop head is compressed inside it. The cylinder has an O-ring about its bottom periphery to seal the cylinder and prevent the cylinder from scratching the floor. The cylinder has a wider portion above the O-ring to hold the mop strings in the cylinder when it is lifted from the pail. A specialized pail is provided for rinsing the mop by having a crescent-shaped tray with apertures on its bottom and a clamp on top to hold the mop inside the tray.

8 Claims, 2 Drawing Sheets

CYLINDER ATTACHMENT TO WRING WATER OUT OF MOP IN PAIL WITH HOLDING TRAY

BACKGROUND OF THE INVENTION

1. Field of the Invention

The present invention relates generally to mops. More specifically, the invention is a cylindrical attachment device that is stored on the handle and lowered for use to wring out the mop of water in a specialized pail having a holding tray.

2. Description of the Related Art

The prior art of interest describes various mop wringer devices, but none discloses the present invention. There is a need for a lightweight mop wringer stored on the mop handle and utilized by lowering to wring out the dirty water and rinse the mop head. The related art will be discussed in the order of perceived relevance to the present invention.

U.S. Pat. No. 5,724,694 issued on Mar. 10, 1998, to Larry I. Lewis describes a self-squeezing mop having a cylinder which extends to squeeze the wet mop by a ring comprising five angularly disposed stationary rollers in the form of a pentagon. The device is distinguishable for requiring rollers.

U.S. Pat. No. 4,164,800 issued on Aug. 21, 1979, to Martin P. Strahs describes a combination mop and wringer device comprising a slide arm reciprocates on the mop handle to push a pivotal split ring member over the strand mop to wring out excess water. The device is distinguishable for requiring a split ring member.

U.S. Pat. No. 3,462,788 issued on Aug. 26, 1969, to Tom L. Abbott describes a mop wringer device comprising a perforated sleeve mounted on a mop handle to slide down to compress the wet mop head. The device is distinguishable for requiring a handle grip on the proximate end of the device.

U.S. Pat. No. 5,976,266 issued on Nov. 2, 1999, to Ronald K. Anderson et al. describes a method of cleaning and wringing out a mop comprising the use of a plunger sleeve mounted by a spring-loaded button on a mop handle and having apertures at its distal end. A plunge post in the bottom of a bucket effects the removal of the water from the mop. The mop device is distinguishable for requiring a spring-loaded button to hold up the sleeve and a bucket with a plunge post.

U.S. Patent Application Publication No. US 2002/0092105 A1 published on Jul. 18, 2002, for Christopher Laux et al. describes a mop with a self-contained wringer sleeve comprising a vinyl cylindrical hand grip adjacent an upper grip portion, a lower mop receiving portion, and a bottom edge having four slots for engaging and twisting the mop strands for facilitating twisting of the mop body by the sleeve. The device is distinguishable for requiring a sleeve with a plurality of slots.

U.S. Pat. No. 1,709,622 issued on Apr. 16, 1929, to Andrew F. Justis describes a mop having a bell-shaped sleeve with upper and lower ears for accommodating a slidable rod connected to the sleeve. A sleeve spring latch is positioned on the handle to hold the sleeve up. The sleeve has four inside ribs which aid in twisting the wet mop inside the sleeve to wring out the mop head. The device is distinguishable for requiring inside ribs and a slidable rod connection.

U.S. Pat. No. 1,751,349 issued on Mar. 18, 1930, to Clifton O. Morgan describes a mop having a telescopic hollow handle open at its bottom and containing a rack bar actuated by a hand crank. A cylindrical portion at the distal end confines the mop head. The mop is distinguishable for requiring an internal rack bar and an external hand crank.

U.S. Pat. No. 3,040,354 issued on Jun. 26, 1962, to Peter S. Vosbikian et al. describes a mop with an extracting mechanism comprising an extractor rod parallel to the handle that extends a circular extractor over a wet mop head. The device is distinguishable for requiring a circular extractor to traverse the mop head.

U.S. Pat. No. 3,364,512 issued on Jan. 23, 1968, to Shusuke Yamashita et al. describes a mop squeezing cover slidable on the mop handle comprising a conical pleated cover having a holding sleeve on top. The device is distinguishable for requiring a pleated cover on the handle.

U.S. Pat. No. 5,060,338 issued on Oct. 29, 1991, to James P. Yates et al. describes a wet mop with a self-contained wringer comprising a downwardly movable hand grip on the handle and a polypropylene sleeve having four grooves at the distal end of the handle. The device is distinguishable for requiring a movable grip for contacting the sleeve.

U.S. Pat. No. 5,675,858 issued on Oct. 14, 1997, to Robert von Meyer describes a string mop with an affixed wringer assembly which slides over the wet mop head to extract water. A collar is forced over a pleated sleeve that compresses the enclosed mop head. The device is distinguishable for requiring a squeezable pleated sleeve.

U.S. Pat. No. 5,996,161 issued on Dec. 7, 1999, to Andrew G. Facca describes a self-wringing mop comprising an apertured sleeve on the end of the handle including the swab that is rotated in one direction to remove the mop head and in the opposite direction to wring the mop head. The device is distinguishable for requiring a sleeve with a removable property.

U.S. Pat. No. 6,115,869 issued on Sep. 12, 2000, to Robert J. Libman describes a wringer mop comprising a conventional handle with mop fibers extending from its distal end and a collar that can be raised to an axial position and twisted to wring out the mop and automatically causes a pawl on a ring fixed on the handle to engage to engage a set of raised internal ribs inside the collar to prevent the mop from unwinding. By pushing the collar down the handle, the mop can be returned to normal use. The device is distinguishable for requiring a pawl element for engaging the raised internal ribs of the collar. See also http://www.libmanjansan.com/catalog/pages/2000.html that shows a Libman Wonder Mop (registered), Nov. 18, 2003, page 1. The device has a steel rod handle and a wringer sleeve apertured from its reduced neck portion the length of the wringer sleeve. The device is distinguishable for requiring apertures along its entire length.

U.K. Patent No. 185,941 issued on Sep. 21, 1922, to Eva L. Marshall et al. describes a cylinder having a rotatable brush attached to it slidable on a mop handle. A soap powder case is attached above the brush and cylinder on the handle. The device is distinguishable for requiring a brush on the cylinder and a soap powder case on the handle.

U.K. Patent No. 593,452 issued on Oct. 16, 1947, to Howard Harris et al. describes a mop having a perforated tubular aluminum sheath and a distal pivotable annular scrub brush on its handle. The sheath can be lowered over the mop. The device is distinguishable for requiring a pivotal brush.

France Patent No. 2 622 785 A1 published on Sep. 11, 1987, for Deimel Helmut et al. describes a mop having a cleaning head fitted with a plurality of textile fringes arranged in the form of a star, and a socket for squeezing out water. The device is distinguishable for requiring a cleaning head having a star-shape.

German Patent No. DE 36 07 121 A1 published on Sep. 10, 1987, for Helmut Deimel et al. describes, a sliding mop head cover having elongated apertures on its distal end. The device is distinguishable for requiring elongated apertures on the sliding mop head cover.

None of the above inventions and patents, taken either singly or in combination, is seen to describe the instant invention as claimed. Thus, a cylinder attachment to wring water out of a dirty mop and a pail solving the aforementioned problems are desired.

SUMMARY OF THE INVENTION

The cylinder attachment to wring water out of a mop comprises a frusto-conical shaped cylinder having a neck that is slidably attached to a mop handle. The mop handle has two clips to hold the cylinder up on the handle when the cylinder is not in use. The cylinder has an array of apertures in its lower, wider portion that allow for release of the mop water when the cylinder is lowered over the dirty, water-laden mop head to squeeze out the gray water. At least one aperture is located above the array of apertures to drain water that is squeezed from the top of the mop head as it collects inside the cylinder.

The reduced neck of the cylinder has an adjustable knob that enables the cylinder to be secured into position on the mop handle when the mop is used for scrubbing and mopping, or while the mop is in storage. The adjustable knob tightens a band that slips around the inside surface of the reduced neck of the cylinder so that the band secures around the mop handle. A groove may be cut into the inside surface of the neck into which the band shall sit. Alternatively, the band may surround the outside of the reduced neck to tighten the neck down against the mop handle, or the neck may be molded with two protrusions which can be tightened together by turning a threaded bolt. Any other conventional manner for tightening the cylinder in place along the mop handle may be used according to the present invention.

The lower end of the cylinder contains a rubber O-ring that both seals the cylinder when the mop is being compressed inside the cylinder to squeeze the water out and provides a softer edge when the mop is being pushed across the floor. When the cylinder is secured in place along the mop handle so that just one or two inches of mop strings extend beyond the end of the cylinder, the mop can be used for scrubbing. The rubber O-ring prevents the cylinder from scratching the floor during this scrubbing use.

Just above the O-ring, the inside of the cylinder flares out slightly to create an expansion lock, into which the mop strings are pushed when compressed. This expansion lock then holds the compressed mop strings inside the cylinder as the mop is lifted from the bucket. The expansion lock may have any profile, so long as the middle portion of the expansion lock is wider than the main portion of the cylinder and the bottom opening of the cylinder inside the O-ring. Any other convention, such as a restrictor ring, that is located at the end of the cylinder and has a smaller diameter than the cylinder to prevent the mop strings from coming out of the cylinder may be used in alternative to an expansion lock.

A specially adapted rinsing bucket is provided with a crescent shaped tray having an apertured bottom and an open front for accepting the mop head. The apertured bottom of the tray sits several inches above the bottom of the bucket, and allows the mop to be squeezed into the bucket without coming in contact with the water already sitting in the bucket. A support fence runs across the edge of the apertured bottom of the tray on the open front. This support fence prevents the apertured bottom from bending or giving when the mop and cylinder are compressed against the apertured bottom. The vertical wall of the tray extends further around the wall of the bucket, and a clip is attached to the extended part of the vertical wall above the open bottom of the bucket. The reduced neck of the cylinder can be secured in the clip so that the mop is held with the bucket and tray when in storage. The extended wall of the tray also includes a hole through which the end of the handle of the bucket passes, to secure the tray to the bucket.

Accordingly, it is a principal object of the invention to provide an in situ wet mop wringer device slidably attached to a mop handle according to the present invention.

It is another object of the invention to provide a wet mop wringer device cylindrical in shape with an upper reduced neck according to the present invention.

It is another object of the invention to provide a wet mop wringer device cylindrical in shape with an upper reduced neck having an adjustable knob to secure the cylinder in the scrubbing, mopping and storage positions according to the present invention.

It is a further object of the invention to provide a wet mop wringer device having an array of apertures in its lower portion according to the present invention.

It is a further object of the invention to provide a wet mop wringer device having at least one aperture in its lower portion that is located above the top of the compressed mop according to the present invention.

Still another object of the invention is to provide a wet mop wringer device held in storage on the mop handle by clips according to the present invention.

It is another object of the invention to provide a mop wringer device that is attached to the mop handle and which allows water to be squeezed from the mop head while the mop head is submerged within a bucket that is already holding water.

Still another object of the invention is to provide a wet mop wringer device that prevents the mop strings from getting wet during the retraction of the mop from a bucket with water after water is squeezed from the mop head.

It is a further object of the invention to provide a wet mop wringer device that has an o-ring to help seal the device as the water is squeezed from the mop head and to prevent scratching of the floor during use of the mop.

Yet still another object of the invention is to provide a specialized rinsing bucket having a crescent shaped tray according to the present invention.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
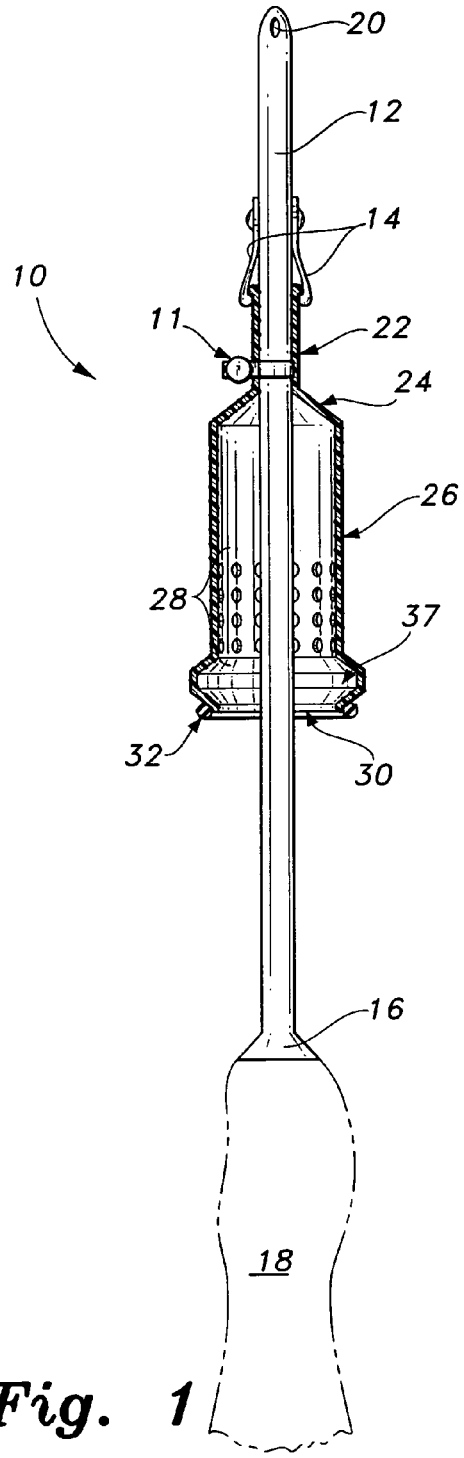
FIG. 1 is an elevational cross-sectional view of a mop having a cylinder attachment to wring water out of the mop according to the present invention.
Figure 2:
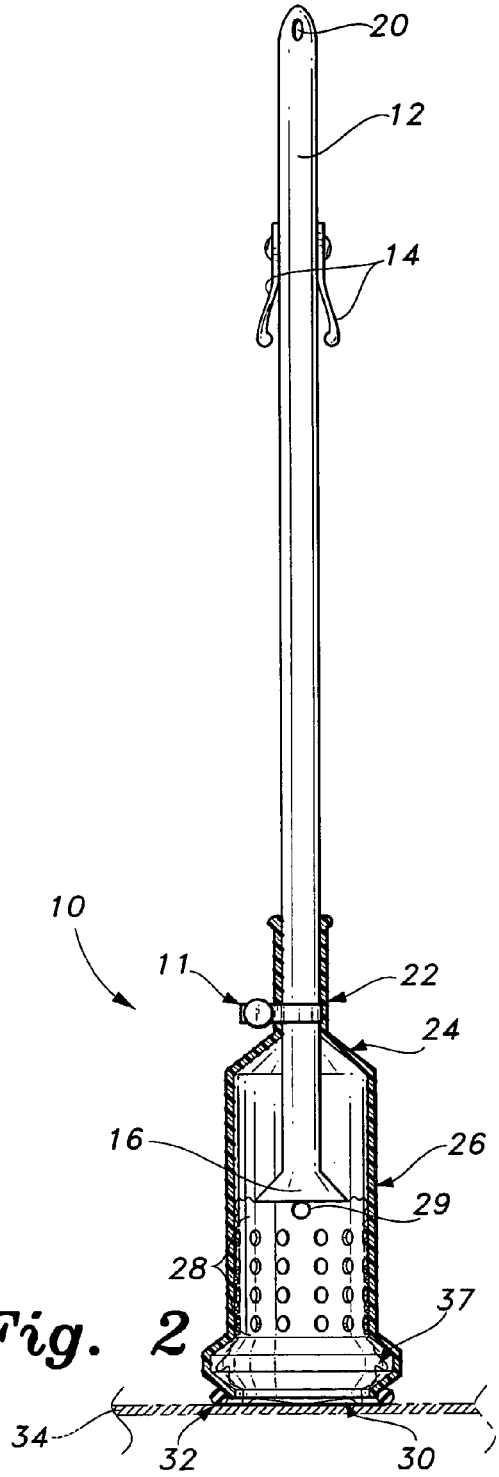
FIG. 2 is an elevational cross-sectional view of the cylinder attachment squeezing out the dirty water from a mop according to the present invention.
Figure 3:
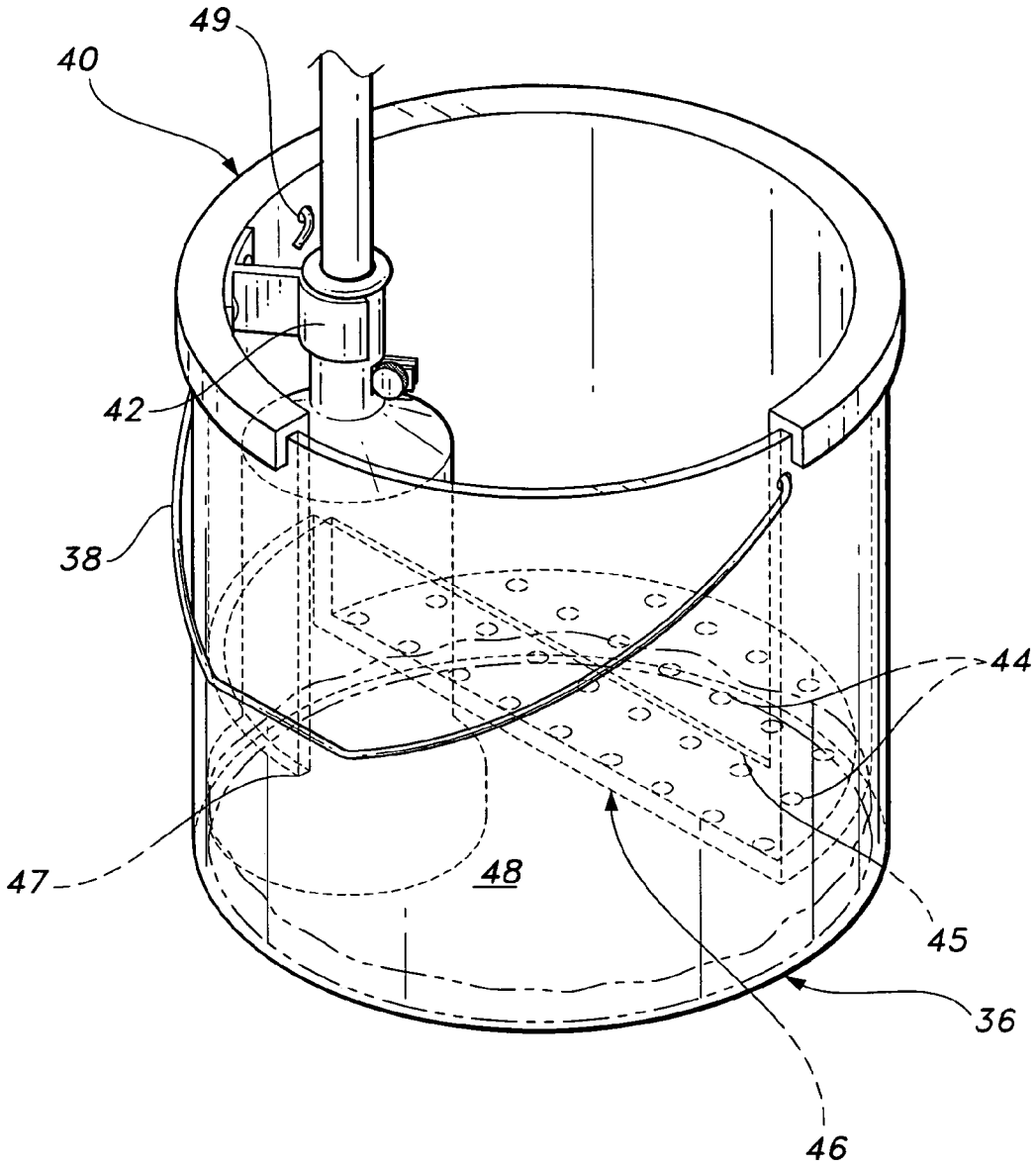
FIG. 3 is a perspective view of a mop in a specialized pail having a holding tray according to the present invention.

The present invention is directed in FIGS. 1 to 3 to a combination of a cylinder attachment device, designated generally as 10 in the drawings, attached on a mop handle 12. The cylinder attachment 10 is held in place by a pair of clips 14 at the top of the mop handle 12 when the mop is in use. A mop connector 16 at its distal end holds the releasable mop head 18 made of conventional cloth strands. The mop handle 12 has an aperture 20 at its proximate end for hanging on a wall.

The cylinder attachment 10 (cross-sectioned in FIGS. 1 and 2) has at its top a reduced neck portion 22, optionally having an O-ring around its inside surface that stabilizes the attachment 10 on the mop handle 12. The lower end of the reduced neck 22 has an adjustable knob 11 that allows the cylinder attachment 10 to be fixed in position anywhere along the mop handle 12. The adjustable knob 11 shown in FIGS. 1 to 3 is turned to tighten a band that runs around the inside surface of the reduced neck 22, securing the band around the mop handle 12. The band passes through a slot in the reduced neck 22, so that it may be accessed by the knob 11 outside of the reduced neck 22.

Below the reduced neck 22, the cylinder attachment 10 has a frusto-conical portion 24 and an enlarged cylindrical portion 26. An array of apertures 28 pass through the lower end of the enlarged cylindrical portion 26, allowing water to be released from the enlarged cylindrical portion 26 when the mop head 18 is compressed inside the enlarged cylindrical portion 26. At least one aperture 29 is located above the array of apertures 28, so that when the mop head 18 is compressed, any water that is squeezed out of the top of the mop head 18 can be released from the cylinder 10.

The enlarged cylindrical portion 26 has an enlarged open bottom 30 of the same diameter as the enlarged cylindrical portion 26. The enlarged open bottom 30 contains a rubber O-ring 32. The rubber O-ring 32 seals the bottom 30 when the mop head 18 and cylinder 10 are pressed against a sink bottom 34 (FIG. 2) or the bottom of the pail 36 (FIG. 3). The rubber O-ring 32 also prevents the enlarged cylindrical portion 26 from scratching the floor during mopping or scrubbing by providing a softer contact surface.

The inside surface of the enlarged cylindrical portion 26 flares out in the area above the rubber O-ring 32 but below the array of apertures 28, defining an expansion lock 37. The expansion lock receives the ends of the mop head 18 strings when the mop head 18 is compressed, and holds the strings in the cylinder attachment 10 when the mop is lifted from the sink 34 or pail 36. By holding the strings in the cylinder attachment 10, the expansion lock 37 allows the mop head 18 to be compressed and generally dried inside a bucket full of water by not allowing the water to soak back against the mop head 18 when the compression pressure is released and the mop is removed from the bucket.

In FIG. 3, the rinsing pail 36 has a conventional handle 38. The pail 36 is modified with a crescent-shaped holding tray 40 attached to its rim. The tray 40 has a clamp 42 for attaching the reduced neck 22 to hold the mop for storage. The tray 40 has an open front and apertures 44 at its bottom 46 for drainage of the mop head 18. A support fence 45 stretches across the bottom of the open front along the edge of the apertured bottom 46 of the tray 40. The support fence 45 strengthens the bottom 46 so that it does not bend when the mop head 18 is compressed against the bottom 46. The apertured bottom 46 sits several inches above the bottom of the pail 36, allowing the apertured bottom 46 to remain above the rinsing water 48 that sits in the pail 36.

The tray 40 has a vertical wall 47 that runs around the inside of the sidewall of the pail 36. The vertical wall 47 extends further around the side of the pail 36 than does the apertured bottom 46. The pail handle 38 passes through a hole 49 in the vertical wall 47, removably securing the tray 40 to the pail 36. The clamp 42 for holding the mop in storage is attached to the vertical wall 47 above the open bottom of the pail 36. The clamp 42 is positioned away from the apertured bottom 46 so that the mop head 18 can be compressed against the apertured bottom 46 without the mop handle 12 being obstructed by the clamp 42.

Exemplary dimensions of the cylinder attachment device 10 are as follows:

Mop handle 12: Cylindrical, approximately 1 in. diameter, 3.5 ft. in length, metal, plastic or wood.

Mop head 18: Conventional cloth strands.

Clips 14: A pair, spring metal, snap to fit around 1 in. handle.

Cylinder attachment device 10: Metal or plastic, 20 in. height (or about 3 in. longer than mop head 18), neck portion 22 6 in. length including the frusto-conical portion 24; enlarged cylindrical portion 26, 14 in. length and 2 in. diameter; array of apertures 28 approximately 0.1875 in. diameter; additional aperture 29 approximately 0.1875 in. diameter; rubber O-ring 32 at the distal end or bottom of device approximately 2 in. diameter; expansion lock 37 approximately 0.5 in. wider than enlarged cylindrical portion 26.

Thus, a combination of a mop having a wringer cylinder attachment and a rinsing pail with a mop holder has been shown.

It is to be understood that the present invention is not limited to the embodiment described above, but encompasses any and all embodiments within the scope of the following claims.

I claim:

1. A cylinder attachment on a mop handle to wring water out of a mop head by compression, and a specialized pail, comprising:

a mop having a string mop head attached to an elongated handle;

a cylindrical element having a reduced diameter neck slider portion abutting an increasing diameter conical neck portion, and an enlarged cylindrical body portion having an array of apertures proximate a lower portion thereof;

a sealing O-ring about a bottom periphery of said enlarged cylindrical body portion;

said enlarged cylindrical body portion including an expansion lock;

said expansion lock comprising a wider inside portion of said enlarged cylindrical body portion between said array of apertures and said sealing O-ring; and a specialized pail having a tray with an apertured bottom.

2. The cylinder attachment on a mop handle to wring water out of a mop head by compression, and specialized pail according to claim 1, further comprising an adjustable knob on a lower end of the reduced diameter neck slider portion for temporarily securing said cylinder attachment in position at any point along said handle.

3. The cylinder attachment on a mop handle to wring water out of a mop head by compression, and specialized pail according to claim 1, further comprising said cylindrical element having an aperture above and separate from said array of apertures.

4. The cylinder attachment on a mop handle to wring water out of a mop head by compression, and specialized pail according to claim 1, further comprising clips on said handle for securing said cylinder attachment to said handle when said cylinder attachment is not in use.

5. The cylinder attachment on a mop handle to wring water out of a mop head by compression, and specialized pail according to claim 1, wherein said specialized pail includes an upper peripheral lip, and said tray comprises a semi-cylindrical structure configured to be suspended from the upper peripheral lip of said specialized pail, said tray being formed as a horizontal extension from said semi-cylindrical structure.

6. The cylinder attachment on a mop handle to wring water out of a mop head by compression, and specialized pail according to claim 1, wherein said tray comprises a clamp whereby said mop may be secured to said tray when in storage.

7. The cylinder attachment on a mop handle to wring water out of a mop head by compression, and specialized pail according to claim 1, wherein said cylinder attachment, specialized pail and tray are made of a plastics material.

8. The cylinder attachment on a mop handle to wring water out of a mop head by compression, and specialized pail according to claim 1, wherein said cylinder attachment, specialized pail and tray are made of metal.

* * * * *